US009574562B2

(12) United States Patent
Van Dam et al.

(10) Patent No.: US 9,574,562 B2
(45) Date of Patent: Feb. 21, 2017

(54) SYSTEM AND APPARATUS FOR PUMPING A MULTIPHASE FLUID

(71) Applicant: General Electric Company, Schenectady, NY (US)

(72) Inventors: Jeremy Daniel Van Dam, West Coxsackie, NY (US); Vittorio Michelassi, Munich (DE); Ismail Hakki Sezal, Munich (DE); Xuele Qi, Niskayuna, NY (US); Rene du Cauze de Nazelle, Munich (DE); Vishal Gahlot, Moore, OK (US); Scott Richard Erler, Edmond, OK (US)

(73) Assignee: General Electric Company, Niskayuna, NY (US)

( * ) Notice: Subject to any disclaimer, the term of this patent is extended or adjusted under 35 U.S.C. 154(b) by 739 days.

(21) Appl. No.: 13/961,680

(22) Filed: Aug. 7, 2013

(65) Prior Publication Data

US 2015/0044027 A1 Feb. 12, 2015

(51) Int. Cl.
*F04D 3/02* (2006.01)
*F04D 29/18* (2006.01)

(52) U.S. Cl.
CPC ..... *F04D 3/02* (2013.01); *F04D 29/183* (2013.01)

(58) Field of Classification Search
CPC ..... F04D 3/02; F04D 29/54; F04D 29/18; F04D 29/44; F04D 29/14; F04B 17/00; F04B 35/04
See application file for complete search history.

(56) References Cited

U.S. PATENT DOCUMENTS 98,665 A 1/1870 Chadwick
3,204,562 A 9/1965 Norquist
(Continued)

FOREIGN PATENT DOCUMENTS

AU 538411 B2 8/1984
DE 2625818 A1 12/1977
(Continued)

OTHER PUBLICATIONS

International Search Report and Written Opinion issued in connection with corresponding PCT Application No. PCT/US2014/047771 on Oct. 22, 2014.
(Continued)

*Primary Examiner* — Thomas Denion
*Assistant Examiner* — Shafiq Mian
(74) *Attorney, Agent, or Firm* — Andrew J. Caruso

(57) ABSTRACT

A pump for pumping a multiphase fluid includes a housing and a rotor with an outer surface. A plurality of inducer vanes are attached to the rotor hub, each having a leading edge and a trailing edge where the leading edge of one inducer vane overlaps the trailing edge of an adjacent inducer vane by a first overlap angle. A plurality of impeller vanes are also attached to the hub. The impeller vanes each have a leading edge and a trailing edge where the leading edge of one impeller vane overlaps the trailing edge of an adjacent impeller vane by a second overlap angle larger than the first overlap angle. The pump includes a rotor flow channel extending between the hub outer surface and the housing inner surface. The rotor flow channel has an inlet area and an outlet area, whereby the outlet area is smaller than the inlet area.

20 Claims, 12 Drawing Sheets

(56) References Cited

U.S. PATENT DOCUMENTS

| | | | | |
|---|---|---|---|---|
| 3,289,923 | A | 12/1966 | Millman | |
| 3,522,997 | A | 8/1970 | Rylewski | |
| 3,788,765 | A | 1/1974 | Rusak | |
| 4,173,451 | A | 11/1979 | Moore, Jr. | |
| 4,502,837 | A * | 3/1985 | Blair | F01D 5/045 415/198.1 |
| 4,778,341 | A | 10/1988 | Corradini et al. | |
| 4,867,242 | A | 9/1989 | Hart | |
| 4,907,953 | A | 3/1990 | Hebert et al. | |
| 4,968,226 | A | 11/1990 | Brewer | |
| 5,011,371 | A | 4/1991 | Gottemoller | |
| 5,100,299 | A | 3/1992 | Vadasz et al. | |
| 5,375,976 | A | 12/1994 | Arnaudeau | |
| 5,417,547 | A * | 5/1995 | Harada | F04D 29/444 415/208.4 |
| 5,795,135 | A | 8/1998 | Nyilas et al. | |
| 5,873,696 | A | 2/1999 | Harada et al. | |
| 5,927,939 | A | 7/1999 | Harada et al. | |
| 5,947,680 | A | 9/1999 | Harada et al. | |
| 6,135,723 | A | 10/2000 | Hatton | |
| 6,273,690 | B1 | 8/2001 | Fischer, Jr. et al. | |
| 6,382,912 | B1 | 5/2002 | Lee et al. | |
| 6,474,939 | B1 * | 11/2002 | Bratu | F04D 31/00 415/143 |
| 6,589,015 | B1 | 7/2003 | Roberts et al. | |
| 6,676,366 | B2 | 1/2004 | Kao | |
| 6,684,946 | B2 | 2/2004 | Gay et al. | |
| 6,783,331 | B2 | 8/2004 | Lopes et al. | |
| 6,893,207 | B2 | 5/2005 | Kao | |
| 6,923,621 | B2 * | 8/2005 | Sato | F04D 1/063 415/199.2 |
| 7,150,600 | B1 | 12/2006 | Vennat | |
| 7,445,429 | B2 * | 11/2008 | Wilson | F04D 19/022 166/105.5 |
| 7,458,787 | B2 | 12/2008 | Brown et al. | |
| 7,461,692 | B1 * | 12/2008 | Wang | B01D 19/0057 166/105.5 |
| 7,730,937 | B2 | 6/2010 | Head | |
| 7,798,215 | B2 | 9/2010 | Leuthen et al. | |
| 7,810,747 | B2 | 10/2010 | Allaire et al. | |
| 7,841,826 | B1 | 11/2010 | Phillips | |
| 8,141,646 | B2 | 3/2012 | Allen et al. | |
| 8,162,604 | B2 | 4/2012 | Kuhnel et al. | |
| 8,303,272 | B2 | 11/2012 | Pugh et al. | |
| 8,801,360 | B2 * | 8/2014 | Sheth | E21B 43/128 415/1 |
| 2004/0179949 | A1 | 9/2004 | Duran et al. | |
| 2006/0241335 | A1 * | 10/2006 | Benkowski | A61M 1/101 600/16 |
| 2006/0245945 | A1 * | 11/2006 | Wilson | F04D 19/022 417/405 |
| 2007/0248454 | A1 * | 10/2007 | Davis | F04D 3/00 415/74 |
| 2008/0247893 | A1 | 10/2008 | Perkins et al. | |
| 2009/0035122 | A1 | 2/2009 | Yagi et al. | |
| 2011/0123321 | A1 * | 5/2011 | Kilkenny | F04D 29/185 415/185 |
| 2011/0280706 | A1 * | 11/2011 | Meuter | F04D 29/047 415/1 |
| 2012/0048113 | A1 | 3/2012 | Anderson et al. | |
| 2012/0093636 | A1 | 4/2012 | Homstvedt et al. | |
| 2012/0199359 | A1 | 8/2012 | Rodrigues | |
| 2013/0101446 | A1 * | 4/2013 | Kao | F04B 35/04 417/410.1 |

FOREIGN PATENT DOCUMENTS

| | | | |
|---|---|---|---|
| EP | 138480 | A2 | 4/1985 |
| GB | 622394 | A | 5/1949 |
| GB | 798480 | A | 7/1958 |
| GB | 2376250 | A | 12/2002 |
| JP | 58180782 | A | 10/1983 |
| JP | 10028962 | A | 2/1998 |
| WO | 2011063333 | A1 | 5/2011 |
| WO | 2012019650 | A1 | 2/2012 |

OTHER PUBLICATIONS

Abelsson, Christian et al, Development and testing of a hybrid boosting pump, 2011, pp. 1-9, Proceedings of the Annual Offshore Technology Conference.

Bagci, A., Suat et al, Challenges of using electrical submersible pump (ESP) in high free gas applications, 2010, pp. 1-13, Society of Petroleum Engineers—International Oil and Gas Conference and Exhibition in China 2010, IOGCEC.

Kong, Xiangling et al, Experimental study and numerical simulation on a new generation helico-axial multiphase pump, 2010, pp. 847-861, vol. 18, No. 5, Journal of Basic Science and Engineering.

Sun, Datong et al, Modeling gas-liquid head performance of electrical submersible pumps, 2004, pp. 1-9, PVP—vol. 488, American Society of Mechanical Engineers, Pressure Vessels and Piping Division (Publication) PVP.

Ban, Yao-Tao et al, Research on design concept of multiphase helico-axial pumps, 1997, pp. 209-212, Proceedings of the International Symposium on Multiphase Flow, ISMF.

Cao, Shuliang et al, Hydrodynamic Design of Rotodynamic Pump Impeller for Multiphase Pumping by Combined Approach of Inverse Design and CFD Analysis, 2005, pp. 330-338, vol. 127, Journal of Fluids Engineering, Transactions of the American Society of Mechanical Engineers.

* cited by examiner

SYSTEM AND APPARATUS FOR PUMPING A MULTIPHASE FLUID

BACKGROUND

The subject matter disclosed herein relates generally to multiphase fluid pumps and, more particularly, to a helico-axial pump for pumping a multiphase fluid containing high volumes of gas.

Multiphase fluids, such as gaseous and liquid two-phase fluids exist in many areas of technology, such as oil production. Submersible pumping systems, such as systems that contain helico-axial pumps, are often deployed into wells to recover petroleum fluids from subterranean reservoirs. Most submersible pumping systems include one or more impeller and diffuser combinations, commonly referred to as "stages." The impellers rotate within adjacent stationary diffusers. During use, the rotating impeller imparts kinetic energy to the fluid. A portion of the kinetic energy is converted to pressure as the fluid passes through the downstream diffuser.

One drawback to the use of submersible pumping systems in the operations involving multiphase fluids, e.g., petroleum-gas mixtures, is the unintended separation of the multiphase fluid into its liquid and gaseous components. This may become particularly severe for multiphase process fluids characterized by a high gas volume fraction. As the multiphase fluid begins to separate into its liquid and gaseous components, the pump becomes vulnerable to "gas locking" Gas locking generally occurs when the multiphase fluids include a significant gas to liquid ratio. The gas-locking phenomenon occurs as the gas bubbles move into low pressure zones of the fluid flow within the submersible pumping system and phase separation may then occur in the flow. Upon phase separation, the gas phase has a tendency to accumulate in certain regions of the flow passages of the pump. If enough gas accumulates in an area of the flow passages of the pump, gas locking occurs preventing the movement of the multiphase fluid. Thus, gas locking causes inefficient and ineffective pump operation and may lead to a decrease in the performance and/or the useful life of the submersible pumping system, such that it may no longer be possible to pump the multiphase fluid effectively.

BRIEF DESCRIPTION

In one aspect, a helico-axial pump for pumping a multiphase fluid is provided. The helico-axial pump includes a housing having an inner surface and a longitudinal axis. The helico-axial pump also includes a rotor positioned within the housing. The rotor includes an inlet portion and an outlet portion and has a hub with an outer surface. The rotor also includes an inducer section having a plurality of inducer vanes attached to the hub. The inducer vanes each have a leading edge and a trailing edge. The leading edge of a respective inducer vane circumferentially overlaps the trailing edge of an adjacent inducer vane and defines a first overlap angle measured circumferentially from the longitudinal axis of the housing. The rotor also includes an impeller section having a plurality of impeller vanes attached to the hub. The impeller vanes each have a leading edge and a trailing edge. The leading edge of a respective impeller vane circumferentially overlaps the trailing edge of an adjacent impeller vane and defines a second overlap angle measured circumferentially from the longitudinal axis. The first overlap angle is larger than the second overlap angle. Furthermore, the helico-axial pump includes a rotor flow channel.

The rotor flow channel extends between the hub outer surface and the housing inner surface. The rotor flow channel has an inlet area that extends between the hub outer surface and the housing inner surface at the inlet portion of the hub, and an outlet area that extends between the hub outer surface and the housing inner surface at the outlet portion of the hub. The outlet area is smaller than the inlet area.

In another aspect, a system for pumping a multiphase fluid is provided. The system includes a pump driving mechanism for driving a helico-axial pump. The system also includes a fluid conduit. In addition, the system includes a helico-axial pump attached to the pump driving mechanism and the fluid conduit. The helico-axial pump includes at least one stage including a housing having an inner surface and a longitudinal axis. The helico-axial pump also includes a rotor positioned within the housing. The rotor includes an inlet portion and an outlet portion and has a hub with an outer surface. The rotor also includes an inducer section having a plurality of inducer vanes attached to the hub. The inducer vanes each have a leading edge and a trailing edge. The leading edge of a respective inducer vane circumferentially overlaps the trailing edge of an adjacent inducer vane and defines a first overlap angle measured circumferentially from the longitudinal axis of the housing. The rotor also includes an impeller section having a plurality of impeller vanes attached to the hub. The impeller vanes each have a leading edge and a trailing edge. The leading edge of a respective impeller vane circumferentially overlaps the trailing edge of an adjacent impeller vane and defines a second overlap angle measured circumferentially from the longitudinal axis. The first overlap angle is larger than the second overlap angle. Furthermore, the helico-axial pump includes a rotor flow channel. The rotor flow channel extends between the hub outer surface and the housing inner surface. The rotor flow channel has an inlet area that extends between the hub outer surface and the housing inner surface at the inlet portion of the hub, and an outlet area that extends between the hub outer surface and the housing inner surface at the outlet portion of the hub. The outlet area is smaller than the inlet area.

DRAWINGS

These and other features, aspects, and advantages of the present disclosure will become better understood when the following detailed description is read with reference to the accompanying drawings in which like characters represent like parts throughout the drawings, wherein.

Figure 1:
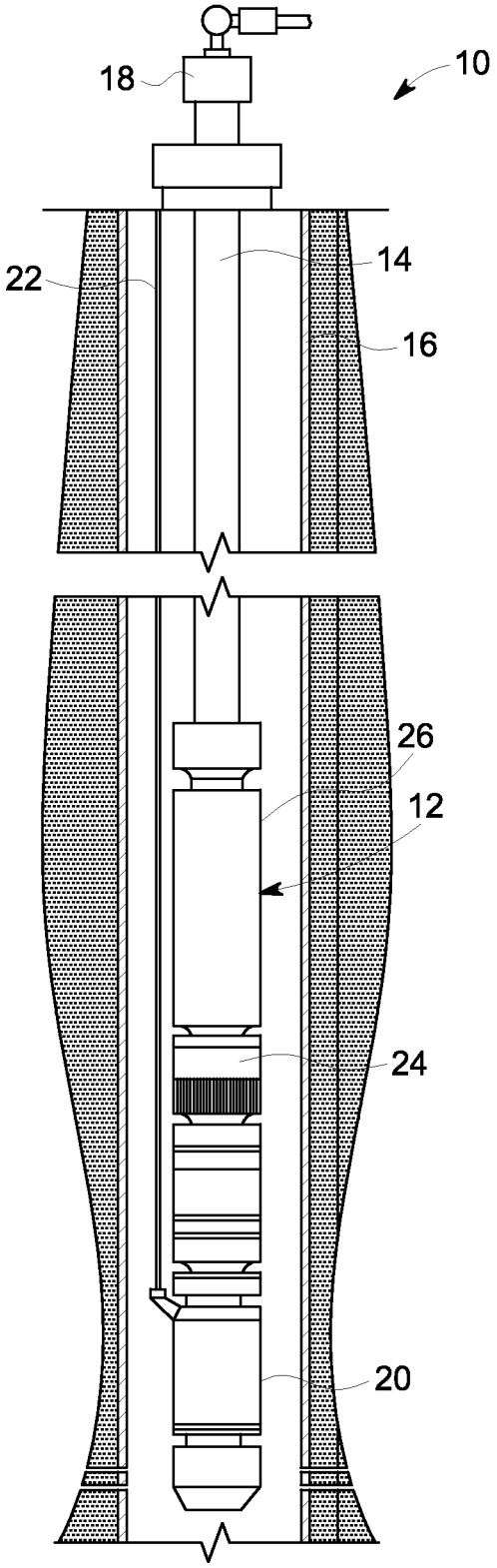
FIG. 1 is a schematic sectional view of a pumping system for pumping a multiphase fluid.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings The singular forms "a", "an", and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise.

The systems and methods described herein relate to a helico-axial pump for pumping a multiphase fluid containing high volumes of gas. The helico-axial pump includes one or more pump stages. Each stage includes a rotor portion and a diffuser or stator portion. The rotor portion has at least two sets of vanes extending radially outwards from a hub. The first upstream set of vanes are referred to as inducer vanes and the second downstream set of vanes are referred to as impeller vanes. The inducer vanes form a substantially helical pattern along a longitudinal axis of the helico-axial pump. The number of inducer vanes and a wrap angle of each inducer vane are selected to have an overlap angle defined between successive inducer vanes. Inducer vane overlap is measured as a rotation angle about the longitudinal axis of the helico-axial pump. An appropriate amount of inducer vane overlap facilitates maintaining the momentum of the multiphase fluid between the inducer vanes, which may reduce the separation of gas from the multiphase fluid. The helico-axial pump includes a low inducer vane count combined with a large overlap angle to impart a low amount of work to the multiphase fluid to facilitate reducing the amount of gas separation from the multiphase fluid. The impeller vanes, likewise, form a substantially helical pattern along the longitudinal axis of the helico-axial pump. The number of impeller vanes and wrap angle of each impeller vane is selected to have an overlap between successive impeller vanes. The helico-axial pump includes a high impeller vane count combined with a small overlap angle to impart a high amount of work to the multiphase fluid to facilitate increasing the pressure of the multiphase fluid. A rotor flow channel defined by the space between the rotor hub and the housing is progressively decreased from the upstream portion of the pump to the downstream portion. Operating a helico-axial pump with a low inducer vane count combined with a large overlap angle, a high impeller vane count combined with a small overlap angle, and a progressively decreasing rotor flow channel facilitates reducing the potential for gas lock and permits the helico-axial pump to pump multiphase fluids that contain a gas phase of 30% or higher by volume.

FIG. 1 is a schematic sectional view of a pumping system 10 for pumping a multiphase fluid. In the exemplary embodiment, pumping system 10 includes a pump assembly 12 coupled to a fluid conduit 14. Pump assembly 12 and a portion of fluid conduit 14 are positioned in a subterranean wellbore 16. In the exemplary embodiment, fluid conduit 14 is coupled between pump assembly 12 and a wellhead 18 located aboveground. Alternatively, pumping system 10 may be operated in any location that permits pumping system 10 to operate as described herein, e.g., aboveground to transfer a multiphase fluid from one storage location to another. In the exemplary embodiment, wellbore 16 is used for oil production, where a petroleum fluid includes a gaseous and liquid multiphase fluid. As used herein, the term "petroleum fluid" refers broadly to mineral hydrocarbons, such as crude oil, natural gas, and combinations of oil and gas. Alternatively, pumping system 10 may be operated to pump any gaseous and liquid multiphase fluid that permits pumping system 10 to operate as described herein.

In the exemplary embodiment, pumping system 10 includes at least pump assembly 12 including a pump 26 and a pump driving mechanism 20, e.g., an electric motor. Pump driving mechanism 20 is coupled to an electrical power source (not shown) from aboveground through a power cable 22. Alternatively, pump driving mechanism 20 may be any type of driving mechanism that permits pump assembly 12 to operate as described herein, e.g., without limitation, a turbine engine or a hydraulic pump drive. In the exemplary embodiment, pump assembly 12 includes an intake portion 24 to permit the petroleum fluid within wellbore 16 to enter pump 26.

Figure 2:
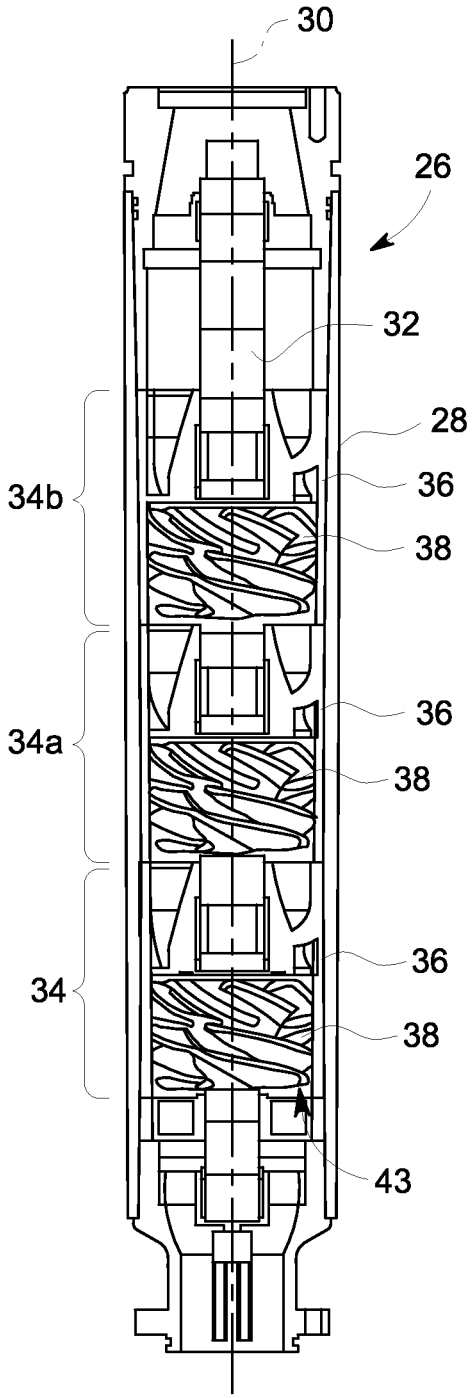
FIG. 2 is a cross-sectional schematic view of a pump that may be used with the pumping system shown in FIG. 1.

FIG. 2 is a cross-sectional schematic view of pump 26 that may be used with pumping system 10 shown in FIG. 1. In the exemplary embodiment, pump 26 is a helico-axial pump. Pump 26 includes a substantially cylindrical housing 28 defining a central axis of rotation 30. A rotatable shaft 32 is positioned substantially coaxial with central axis of rotation 30. Pump 26 also includes at least one stage 34. In the exemplary embodiment, pump 26 includes three substantially identical stages (34, 34*a*, and 34*b*). Stage 34 includes a stator or diffuser 36 secured to housing 28, and a rotor 38 secured to shaft 32 for rotation therewith. Stator 36 and rotor 38 may be attached to housing 28 and shaft 32, respectively, using a fixed connection means, such as, without limitation, a keyed, press-fit, and/or mechanical fastener connection. Alternatively, stator 36 and rotor 38 may be attached to housing 28 and shaft 32, respectively using any connection method that permits stator 36 and rotor 38 to be fixedly connected to housing 28 and shaft 32, respectively. Shaft 32 is configured to transfer mechanical energy from pump driving mechanism 20 to rotor 38. Housing 28, shaft 32, stator 36, and rotor 38 are fabricated from a durable, corrosion-resistant material, such as, without limitation, steel or a steel alloy. Alternatively, housing 28, shaft 32, stator 36, and rotor 38 may be fabricated from any material that permits housing 28, shaft 32, stator 36, and rotor 38 to operate as described herein.

Figure 3:
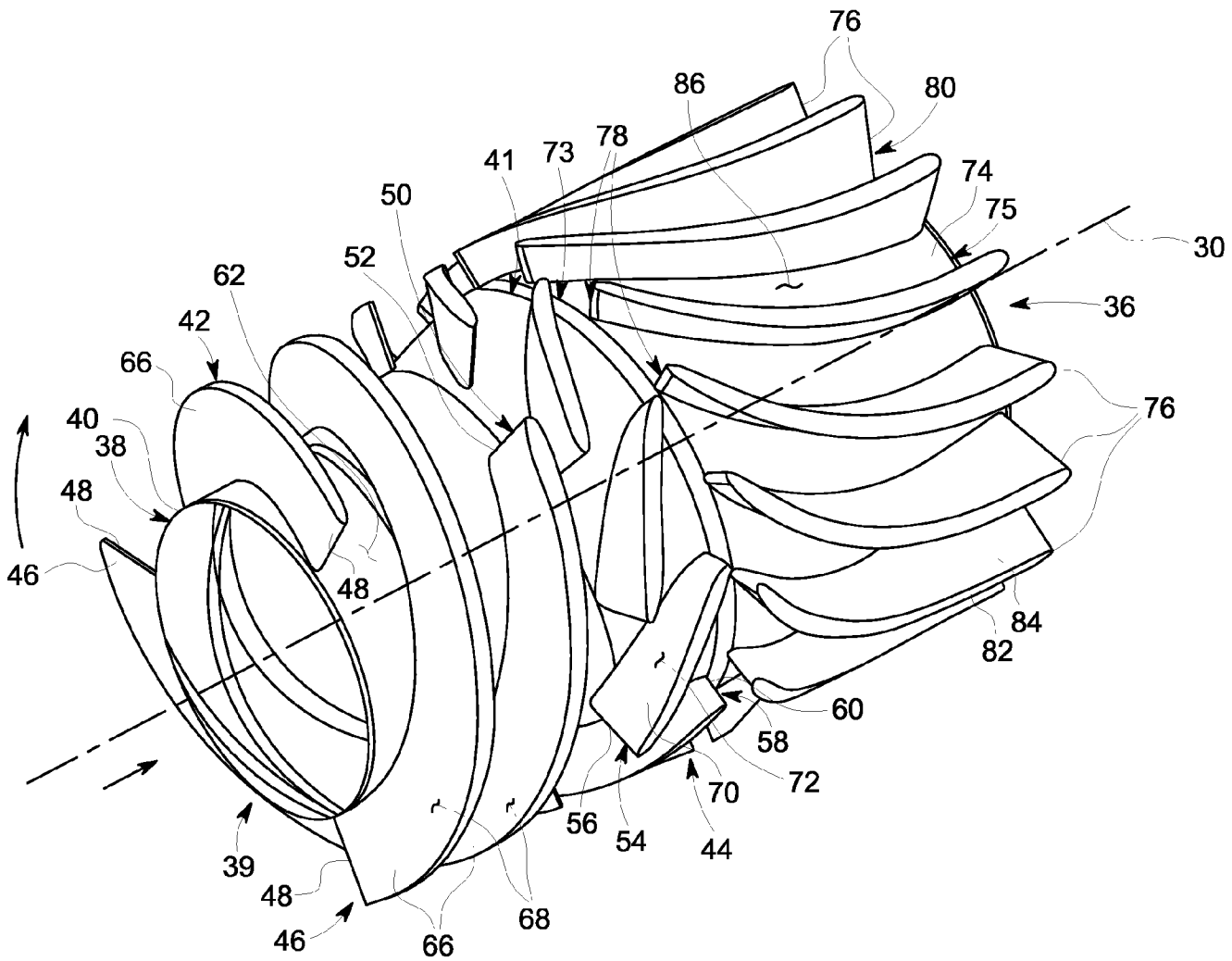
FIG. 3 is a perspective view of a rotor and a stator that may be used with the pump shown in FIG. 2.

FIG. 3 is a perspective view of rotor 38 and stator 36 that may be used with pump 26 shown in FIG. 2. In the exemplary embodiment, rotor 38 includes a rotor hub 40 and a plurality of pump vanes, including inducer vanes 42 and impeller vanes 44. The flow direction of the multiphase fluid is indicated by the arrow that is parallel to central axis of rotation 30 as shown in FIG. 3. Rotor 38 includes an inlet portion 39 and an outlet portion 41 downstream from inlet portion 39. Inducer vanes 42 are attached to rotor hub 40 and positioned upstream from impeller vanes 44. Inducer vanes 42 extend radially from rotor hub 40 and spiral downstream in a helical pattern about central axis of rotation 30. In the exemplary embodiment, rotor 38 includes three inducer vanes 42 that each extend circumferentially through a rotation angle of about 245 degrees about central axis of rotation 30. Alternatively, rotor 38 may include any number of inducer vanes 42 extending about any rotation angle that permit pump 26 to operate as described herein. Inducer vanes 42 each include a leading edge portion 46 defining a leading edge 48 and a trailing edge portion 50 defining a trailing edge 52. Inducer vanes 42 also each include a suction side 66 that faces substantially upstream toward inlet portion 39, and a pressure side 68 that faces substantially downstream toward outlet portion 41.

Impeller vanes 44 are attached to rotor hub 40 and positioned downstream from inducer vanes 42. Impeller vanes 44 extend radially from rotor hub 40 and spiral downstream in a helical pattern about central axis of rotation 30. In the exemplary embodiment, rotor 38 includes nine impeller vanes 44 that each extend circumferentially through a rotation angle of about 45 degrees about central axis of rotation 30. Alternatively, rotor 38 may include any number of impeller vanes 44 extending about any rotation angle that permit pump 26 to operate as described herein. Impeller vanes 44 each include a leading edge portion 54 defining a leading edge 56 and a trailing edge portion 58 defining a trailing edge 60. Impeller vanes 44 also each include a suction side 70 that faces substantially upstream toward inlet portion 39, and a pressure side 72 that faces substantially downstream toward outlet portion 41.

Figure 4:
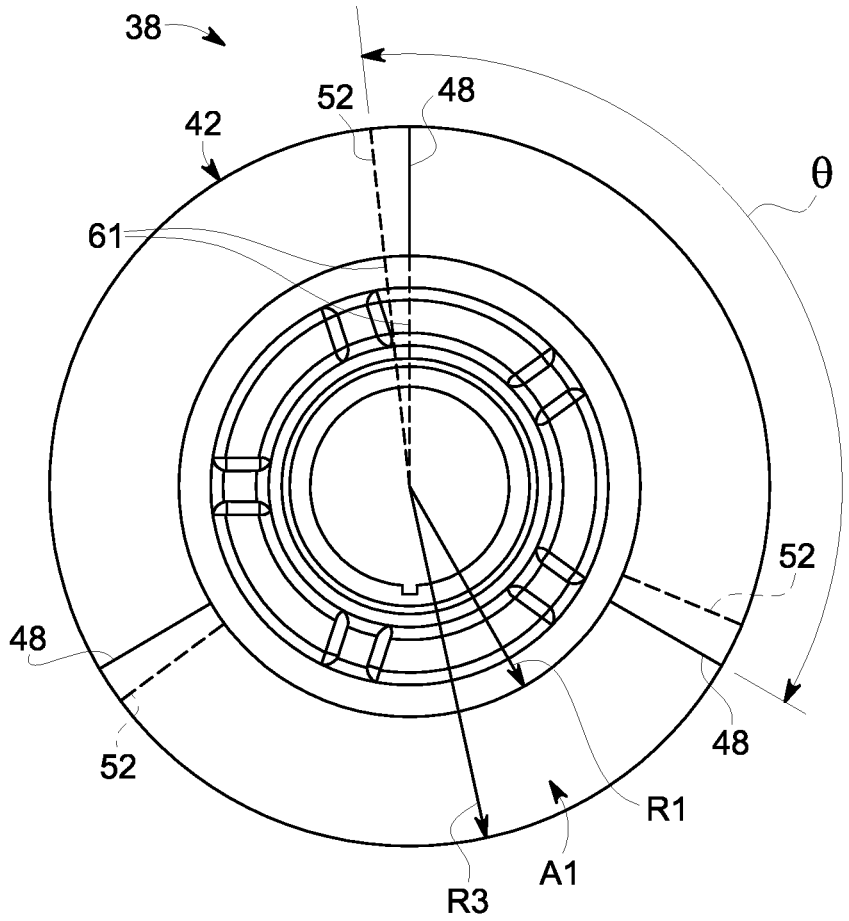
FIG. 4 is a schematic end view of an inlet portion of the rotor shown in FIG. 3 looking downstream toward an outlet portion.

FIG. 4 is a schematic end view of inlet portion 39 of rotor 38 shown in FIG. 3 looking downstream toward outlet portion 41. In the exemplary embodiment, leading edge 48 of inducer vanes 42 is substantially collinear with a hypothetical radial line 61 extending from central axis of rotation 30 outward toward leading edge 48. Likewise, trailing edge 52 of inducer vanes 42 is substantially collinear with a hypothetical radial line 61 extending from central axis of rotation 30 outward toward trailing edge 52. Alternatively, leading edge 48 and trailing edge 52 may be angularly offset from hypothetical radial line 61 any amount that permits rotor 38 to operate as described herein. The number of inducer vanes 42 and wrap angle of each inducer vane is predetermined such that an amount of overlap between adjacent inducer vanes 42 is defined. The amount of overlap is measured as an overlap angle θ about the central axis of rotation 30. In the exemplary embodiment, leading edge 48 is angularly offset from trailing edge 52 of an adjacent inducer vane 42 by overlap angle θ. Overlap angle θ is in the range between about 100 degrees and about 300 degrees, and more particularly, in the range between about 115 degrees and about 135 degrees.

Figure 13:
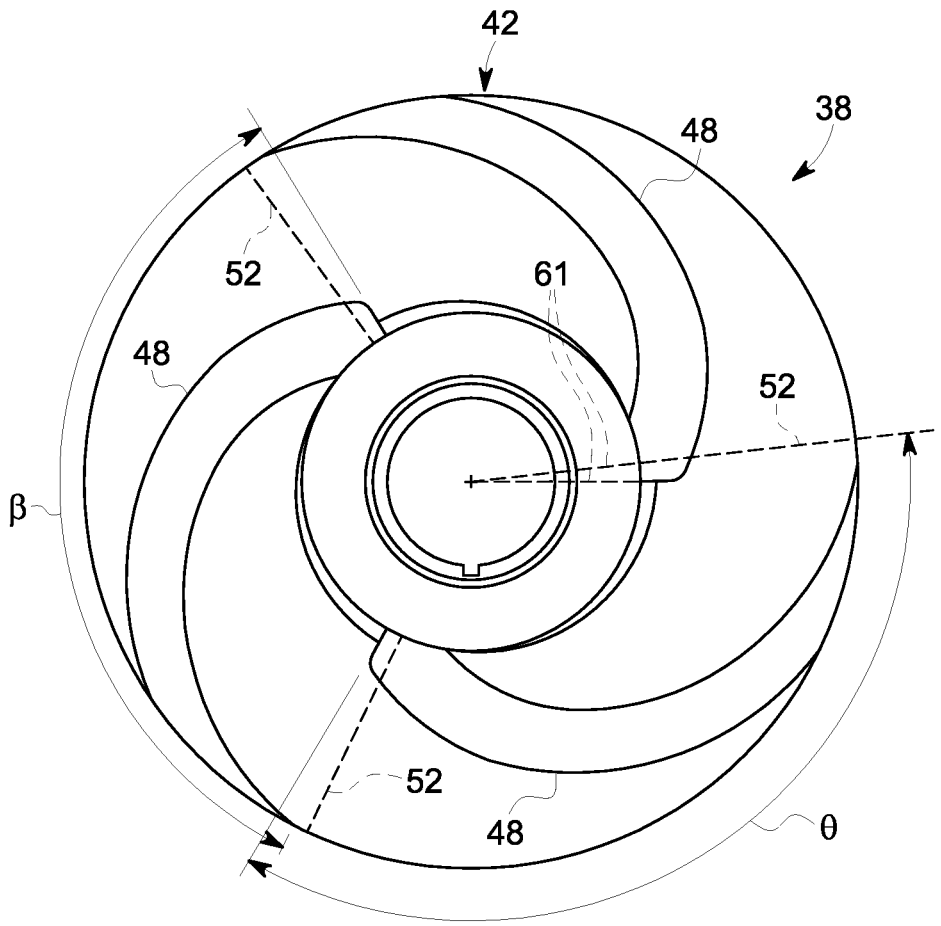
FIG. 13 is a schematic end view the inlet portion of an alternative exemplary rotor for use with the pump shown in FIG. 2 looking downstream toward the outlet portion.

FIG. 13 is a schematic end view of inlet portion 39 of an alternative exemplary rotor 38 for use with pump 26 shown in FIG. 2 looking downstream toward outlet portion 41. In the exemplary embodiment, leading edge 48 of each inducer vane 42 is swept from its intersection with rotor hub 40 in a curvilinear profile towards an outer edge 88 of the respective inducer vane 42. Alternatively or additionally, trailing edge 52 may be swept from its intersection with rotor hub 40 in a curvilinear profile towards an outer edge 88 of the respective inducer vane 42. In the exemplary embodiment, the sweep of leading edge 48 is backward along the flow direction of the multiphase fluid. Alternatively, leading edge 48 may be swept forward, opposite the flow direction of the multiphase fluid. In the exemplary embodiment, an amount of backward sweep of leading edge 48 is measured as a sweep angle β between hypothetical radial lines 61 about central axis of rotation 30. Sweep angle β is in the range between about 0 degrees and about 145 degrees, and more particularly, in the range between about 60 degrees and about 120 degrees. Alternatively, in an embodiment where leading edge 48 is swept forward, sweep angle β may be in the range between about 0 degrees and about 45 degrees.

Figure 5:
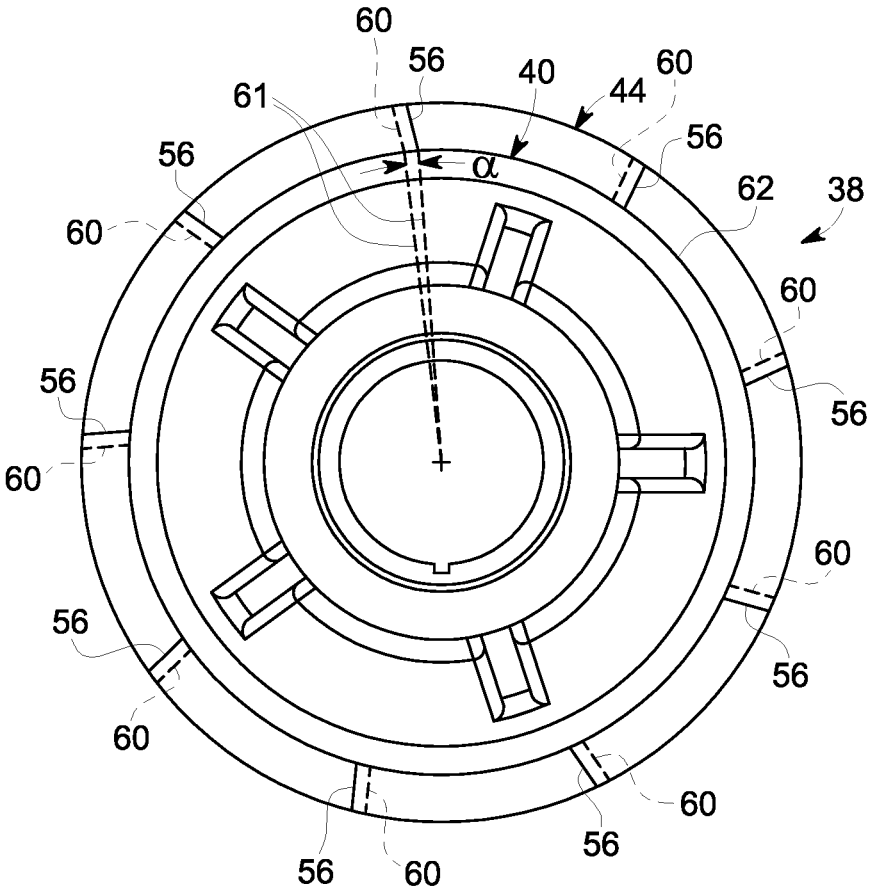
FIG. 5 is a schematic end view of the outlet portion of the rotor shown in FIG. 3 looking upstream toward the inlet portion.

FIG. 5 is a schematic end view of outlet portion 41 of rotor 38 shown in FIG. 3 looking upstream toward inlet portion 39. In the exemplary embodiment, leading edge 56 of impeller vanes 44 is angularly offset from hypothetical radial line 61 extending from central axis of rotation 30 outward toward leading edge 56. Likewise, trailing edge 60 of impeller vanes 44 is angularly offset from hypothetical radial line 61 extending from central axis of rotation 30 outward toward trailing edge 60. Alternatively, leading edge 56 and trailing edge 60 may form a curvilinear profile or may be substantially collinear with hypothetical radial line 61 such that rotor 38 operates as described herein. In alternative embodiments where leading edge 56 or trailing edge 60 form a curvilinear profile, a sweep angle β, shown in FIG. 13, may be in the range between about 25 degrees and 45 degrees. In the exemplary embodiment, the number of impeller vanes 44 and wrap angle of each impeller vane is predetermined such that an overlap between adjacent impeller vanes 44 is defined. The overlap is measured as an overlap angle α about central axis of rotation 30. In the exemplary embodiment, the point where leading edge 56 intersects with a rotor hub outer surface 62 is angularly offset from the point where trailing edge 60 of an adjacent impeller vane 44 intersects with rotor hub outer surface 62 by overlap angle α. Overlap angle α is in the range between about 0 degrees and about 20 degrees, and more particularly, in the range between about 0 degrees and about 10 degrees.

Figure 6:
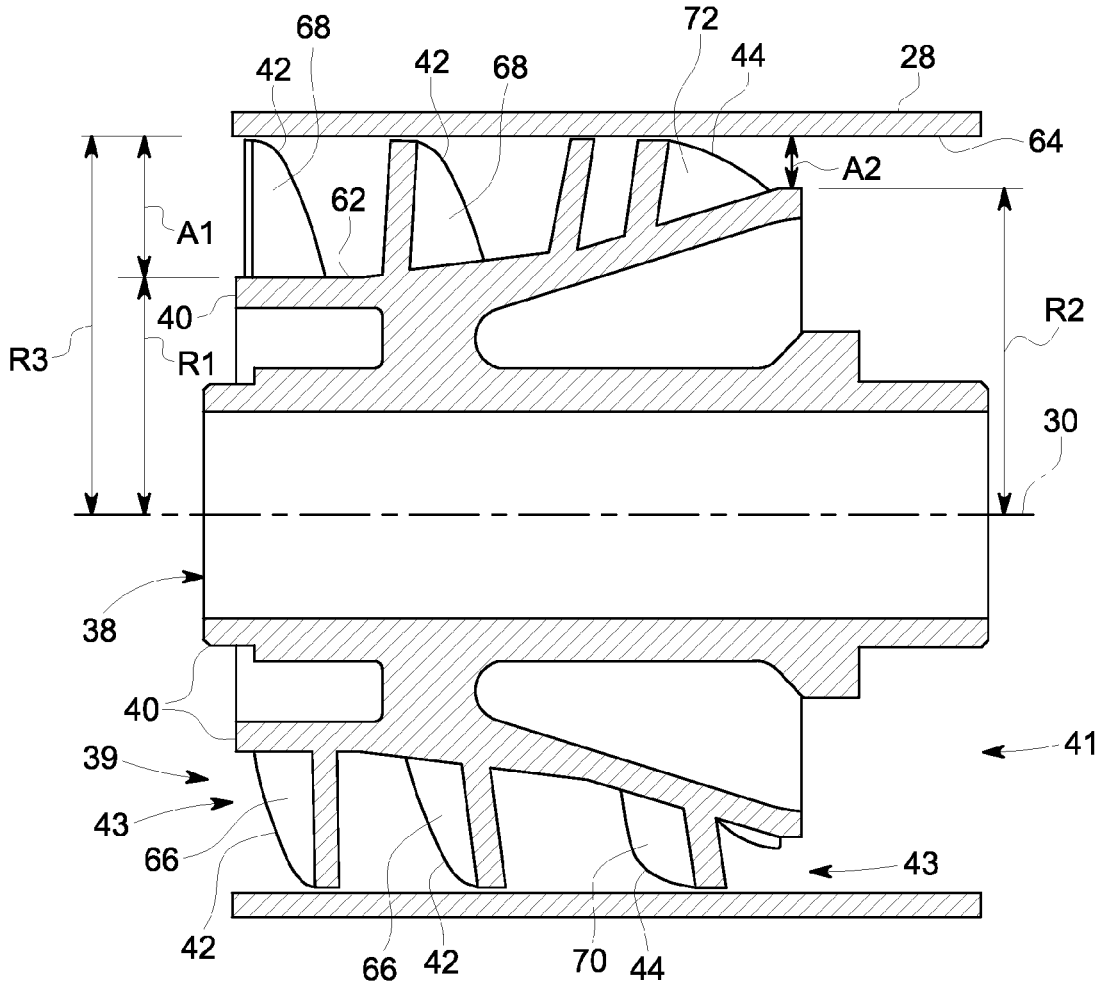
FIG. 6 is a sectional schematic view of the pump shown in FIG. 2 taken about a rotor portion of the pump.

FIG. 6 is a sectional schematic view of pump 26 shown in FIG. 2 taken about the rotor portion of pump 26. The section is taken along a vertical plane containing central axis of rotation 30. In the exemplary embodiment, rotor hub 40 has a first hub radius R1 defined as the distance between central axis of rotation 30 and rotor hub outer surface 62 located at inlet portion 39. Rotor hub 40 also has a second hub radius R2 defined as the distance between central axis of rotation 30 and rotor hub outer surface 62 located at outlet portion 41. Housing 28 has an inner housing radius R3 defined as the distance between central axis of rotation 30 and housing inner surface 64. A flow channel 43 extends between rotor hub outer surface 62 and housing inner surface 64. An area A1 is the swept area about central axis of rotation 30 of flow channel 43, which is defined by the difference between hub radius R1 and housing radius R3. Likewise, an area A2 is the swept area about central axis of rotation 30 of flow channel 43, which is defined by the difference between hub radius R2 and housing radius R3. Area A1 of flow channel 43 is decreased to area A2 from inlet portion 39 to outlet portion 41, and is identified as the "area contraction" of flow channel 43. In the exemplary embodiment, this is accomplished by a progressive increase in the radius of rotor hub 40, such that hub radius R2 is greater than hub radius R1, resulting in area A2 being less than area A1. Alternatively, area contraction may be accomplished by a progressive decrease in housing radius R3 while maintaining a constant rotor hub radius R1, or a combination of an increase in hub radius R1 and a decrease in housing radius R3. In the exemplary embodiment, an area contraction ratio A2/A1 is between about 0.3 and about 0.5, and more specifically between about 0.37 and about 0.45, and still more specifically between about 0.39 and about 0.43.

Referring back to FIG. 3, in the exemplary embodiment, stator 36 includes a stator hub 74 and a plurality of diffuser vanes 76. Stator 36 includes an inlet portion 73 and an outlet portion 75. Diffuser vanes 76 are attached to and extend radially from stator hub 74. Diffuser vanes 76 each extend axially in a generally curvilinear form such that a leading edge 78 pitches towards the direction of rotation of rotor 38, and a trailing edge 80 extends substantially in the axial direction. In the exemplary embodiment, stator 36 includes fourteen diffuser vanes 76. Alternatively, stator 36 may include any number of diffuser vanes 76 that permit pump 26 to operate as described herein. Diffuser vanes 76 each include a pressure side 82 and a suction side 84 opposite pressure side 82, which at least partially define a respective diffuser flow channel for the multiphase fluid.

Figure 7:
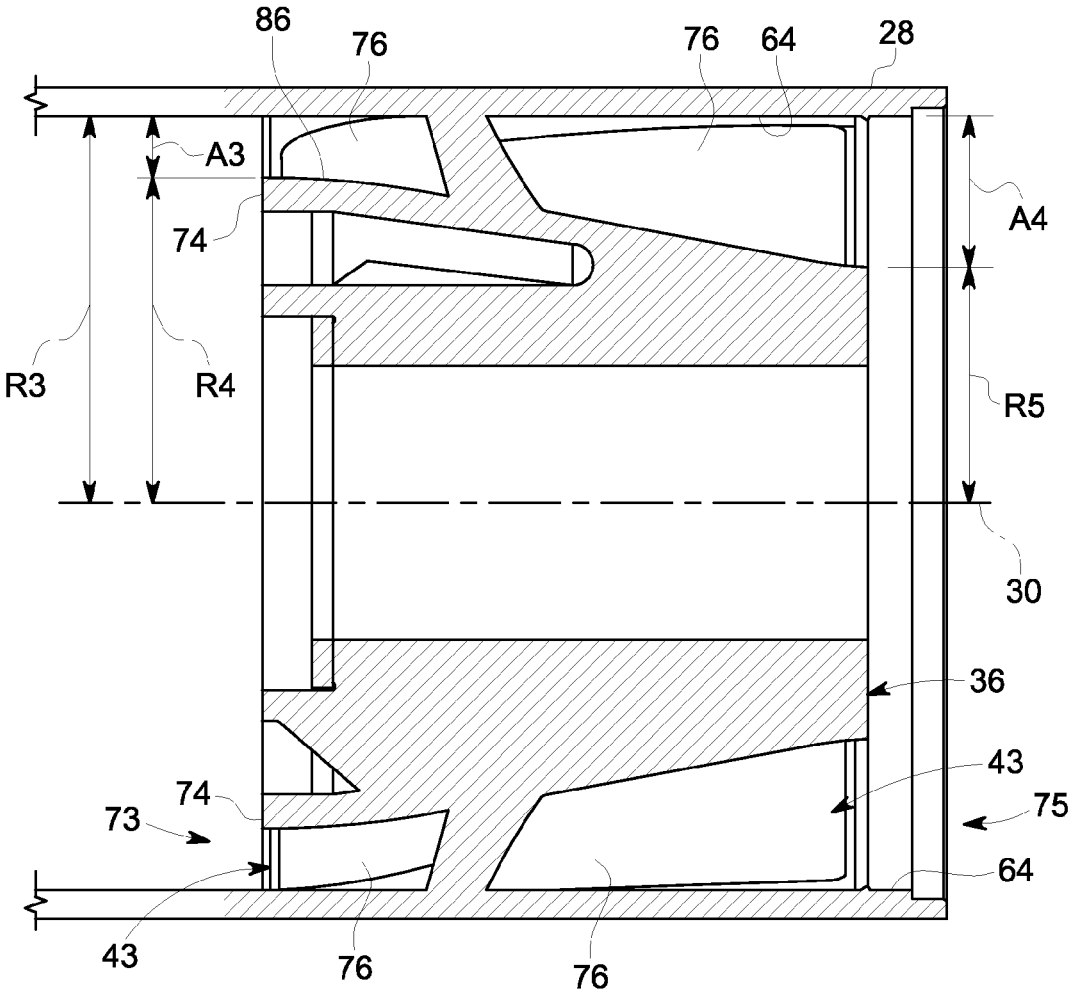
FIG. 7 is a sectional schematic view of the pump shown in FIG. 2 taken about a stator portion of the pump.

FIG. 7 is a sectional schematic view of pump 26 shown in FIG. 2 taken about the stator portion of pump 26. The section is taken along a vertical plane containing central axis of rotation 30. In the exemplary embodiment, stator hub 74 has a first hub radius R4 defined as the distance between central axis of rotation 30 and a stator hub outer surface 86 located at inlet portion 73. Stator hub 74 also has a second hub radius R5 defined as the distance between central axis of rotation 30 and stator hub outer surface 86 located at outlet portion 75. Housing 28 has inner housing radius R3 defined as the distance between central axis of rotation 30 and housing inner surface 64. A flow channel 43 extends between stator hub outer surface 86 and housing inner surface 64. An area A3 is the swept area about central axis of rotation 30 of flow channel 43, which is defined by the difference between hub radius R4 and housing radius R3. Likewise, an area A4 is the swept area about central axis of rotation 30 of flow channel 43, which is defined by the difference between hub radius R5 and housing radius R3. Area A3 of flow channel 43 is increased to area A4 from inlet portion 73 to outlet portion 75, and is identified as the "area expansion" of flow channel 43. In the exemplary embodiment, this is accomplished by a progressive decrease in the radius of stator hub 74, such that hub radius R4 is greater than hub radius R5, resulting in area A3 being less than area A4. Alternatively, area expansion may be accomplished by a progressive increase in housing radius R3 while maintaining a constant stator hub radius R4, or a combination of a decrease in hub radius R4 and an increase in housing radius R3. In the exemplary embodiment, hub radius R4 is substantially equal to hub radius R2 resulting in area A2 being substantially equal to area A3, and hub radius R5 is substantially equal to hub radius R1 resulting in area A4 being substantially equal to area A1. Alternatively, hub radius R4 and hub radius R5 may be any value that permits pump 26 to operate as described herein.

Figure 8:
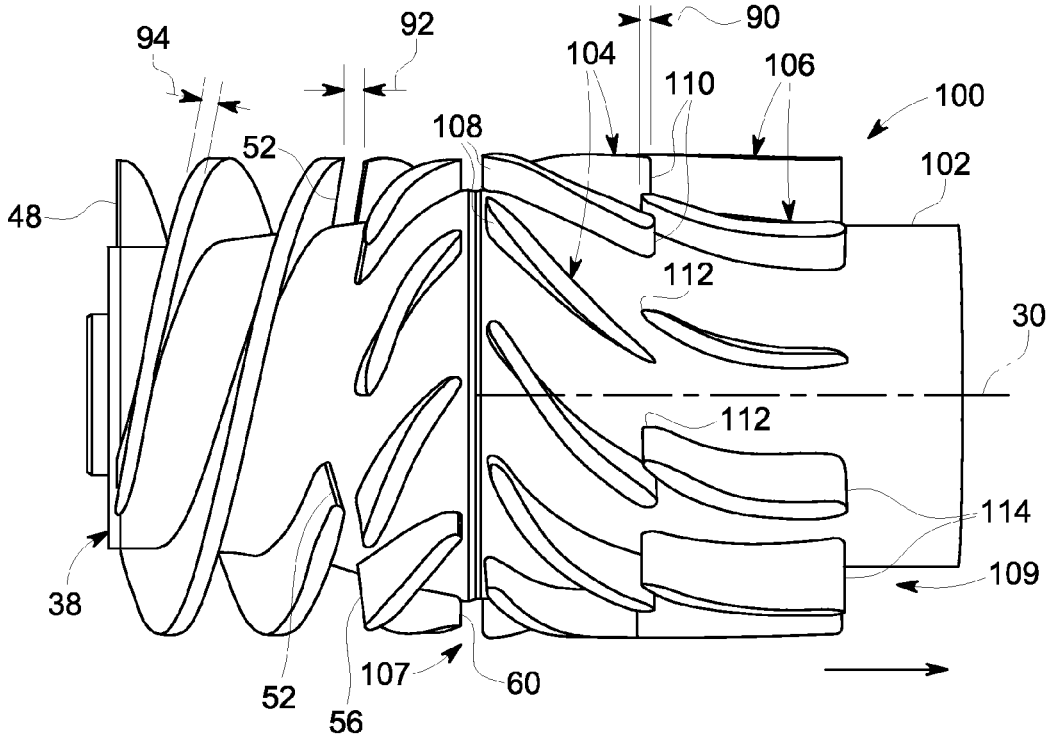
FIG. 8 is a schematic side view of an alternative exemplary stator that may be used with the pump shown in FIG. 2.

FIG. 8 is a schematic side view of an alternative exemplary stator 36 that may be used with pump 26 shown in FIG. 2. In the exemplary embodiment, a stator 100 includes a hub 102 and a plurality of diffuser vanes, including a plurality of upstream diffuser vanes 104 and a plurality of downstream diffuser vanes 106. Stator 100 includes an inlet portion 107 and an outlet portion 109 downstream from inlet portion 107. Upstream diffuser vanes 104 are attached to and extend radially from hub 102 upstream from downstream diffuser vanes 106. Upstream diffuser vanes 104 each extend axially in a generally curvilinear form such that a leading edge portion 108 pitches towards the direction of rotation of rotor 38, and a trailing edge portion 110 turns in the axial direction. Likewise, downstream diffuser vanes 106 are attached to and extend radially from hub 102 downstream from upstream diffuser vanes 104. Downstream diffuser vanes 106 each extend axially in a generally curvilinear form such that a leading edge portion 112 pitches towards the direction of rotation of rotor 38, and a trailing edge portion 114 extends substantially in the axial direction. In the exemplary embodiment, trailing edge portion 110 of upstream diffuser vanes 104 extend axially downstream past leading edge portion 112 of downstream diffuser vanes 106 forming an axial overlap distance 90. Axial overlap distance 90 is predetermined to facilitate reducing separation of the multiphase fluid flow from upstream diffuser vanes 104 and downstream diffuser vanes 106. In the exemplary embodiment, axial overlap distance 90 is in the range between about 1/10 of a characteristic vane thickness 94 and about 10 times characteristic vanes thickness 94. Alternatively, axial overlap distance 90 may be any predetermined distance that permits upstream diffuser vanes 104 and downstream diffuser vanes 106 to operate as described herein.

In the exemplary embodiment, stator 100 includes fourteen upstream diffuser vanes 104 and fourteen downstream diffuser vanes 106. Alternatively, stator 100 may include any number of diffuser vanes 104 and 106 that permit pump 26 to operate as described herein. In the exemplary embodiment, an angle of attack of leading edge portion 112 of downstream diffuser vanes 106 is greater than an angle of attack of trailing edge portion 110 of upstream diffuser vanes 104 creating separation between leading edge portion 112 and trailing edge portion 110 to facilitate control of a flow profile of the multiphase fluid.

With further reference to FIG. 8, in the exemplary embodiment, trailing edge 52 of inducer vanes 42 extend downstream in an axial direction and terminate before leading edge 56 of impeller vanes 44, thus forming an axial separation 92. Axial separation 92 operates as a multiphase fluid mixing chamber. In operation, the multiphase exits fluid flow channel 43 between inducer vanes 42. The multiphase fluid mixture may contain a distribution of gas and liquid that is not homogenous, and as it passes through axial separation 92, the multiphase fluid may further mix before entering impeller vanes 44. In the exemplary embodiment, axial separation 92 is in the range between about 1/10 and about 10 times characteristic vanes thickness 94. Alternatively, trailing edge 52 of inducer vanes 42 may extend downstream in an axial direction past leading edge 56 of impeller vanes 44, wherein axial separation 92 is defined as axial overlap. Axial separation 92 may be any predetermined distance that permits inducer vanes 42 and impeller vanes 44 to operate as described herein.

Figure 9:
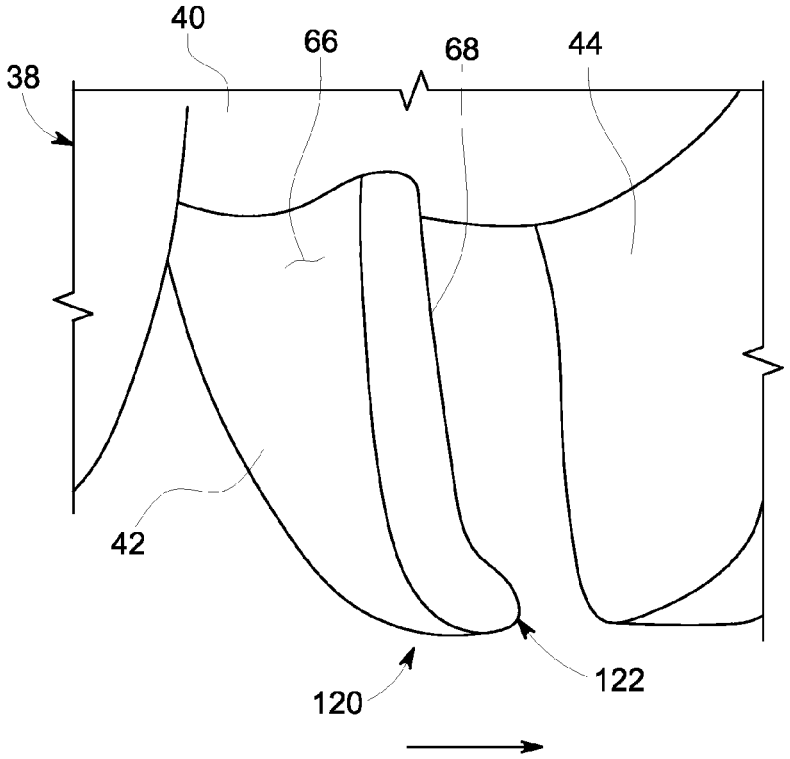
FIG. 9 is a schematic view of an alternative exemplary rotor that may be used with the pump shown in FIG. 2 including a vane tip.

FIG. 9 is a schematic view of an alternative exemplary rotor 38 that may be used with pump 26 shown in FIG. 2 including a vane tip 120. In the exemplary embodiment, inducer vanes 42 include vane tip 120 extending outwardly from pressure side 68 downstream toward outlet portion 41 (shown in FIG. 3). Inducer vanes 42 generally extend radially from rotor hub 40 and include vane tip 120 that is generally curved in the axial direction, thus providing an edge portion 122 to facilitate control of a flow profile of the multiphase fluid. Alternatively or additionally, impeller vanes 44 may include vane tip 120 extending outwardly from pressure side 72 downstream toward outlet portion 41. In alternative embodiments, vane tip 120 may extend downstream from one or more of inducer vanes 42 and impeller vanes 44 such that an intersection of vane tip 120 and inducer vanes 42 and/or impeller vanes 44 form an abrupt transition therebetween. In the exemplary embodiment, edge portion 122 of vane tip 120 is substantially curved. Alternatively, edge portion 122 may be any shape that permits vane tip 120 to operate as described herein.

Figure 10:
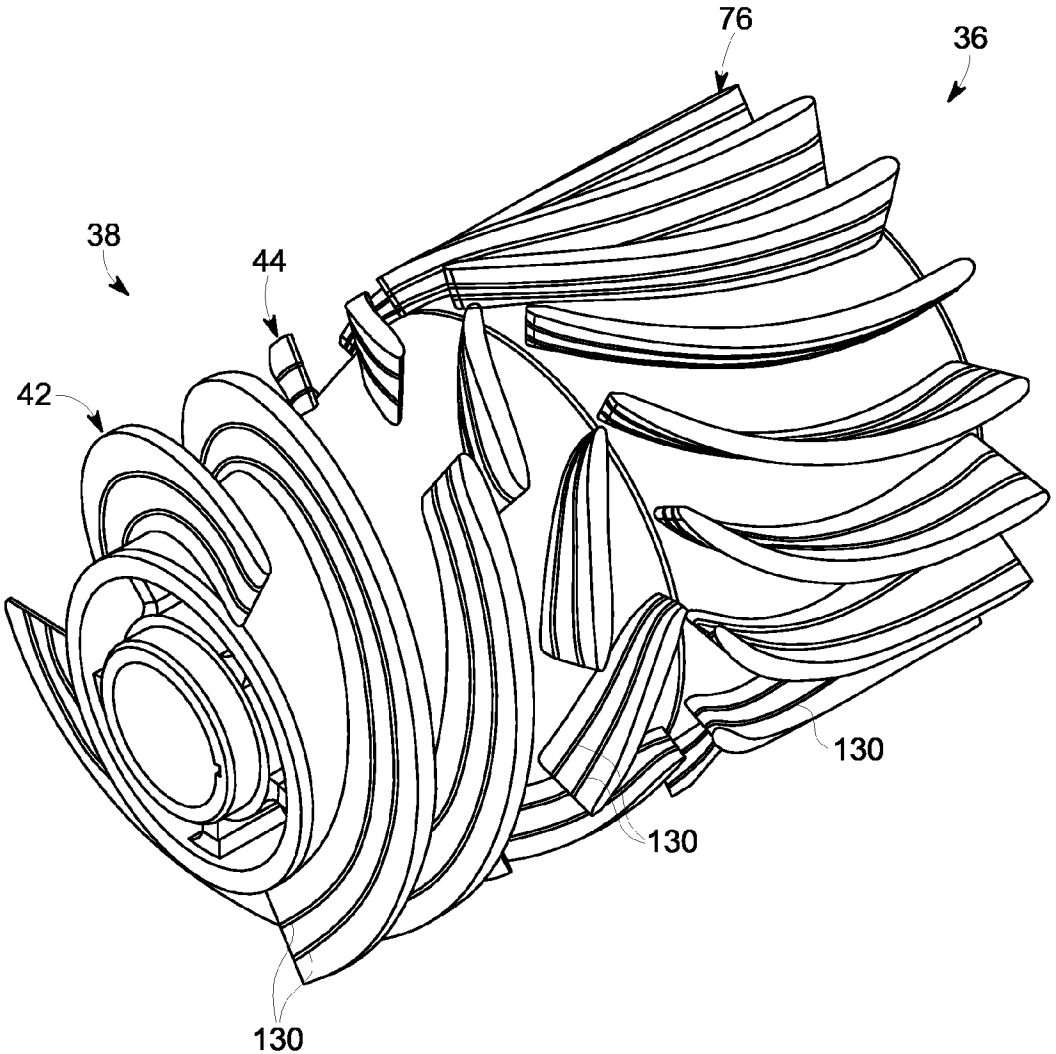
FIG. 10 is a perspective view of an alternative exemplary rotor and stator that may be used with the pump shown in FIG. 2.

FIG. 10 is a perspective view of an alternative exemplary rotor 38 and stator 36 that may be used with pump 26 shown in FIG. 2. In the exemplary embodiment, inducer vanes 42, impeller vanes 44, and diffuser vanes 76 include grooves 130 therein. Grooves 130 facilitate controlling a flow profile of the multiphase fluid. In the exemplary embodiment, grooves 130 extend along inducer vanes 42, impeller vanes 44, and diffuser vanes 76, respectively, and substantially follow a path that is continuous from a respective leading edge to a respective trailing edge of respective vanes 42, 44, and 76. Alternatively, only inducer vanes 42, impeller vanes 44, diffuser vanes 76, or any combination thereof may include grooves 130 therein. In the exemplary embodiment, each vane of inducer vanes 42, impeller vanes 44, and diffuser vanes 76 include two grooves 130 extending along pressure side 68, 72, and 82, respectively, and suction side 66, 70, and 84, respectively, and are equi-spaced between the hub and the tip of the respective vanes. Alternatively, inducer vanes 42, impeller vanes 44, and diffuser vanes 76 may each include more or fewer than two grooves 130, and grooves 130 may be located in any position and extend along an portion of the length of the respective vanes that permit pump 26 to operate as described herein.

Figure 11:
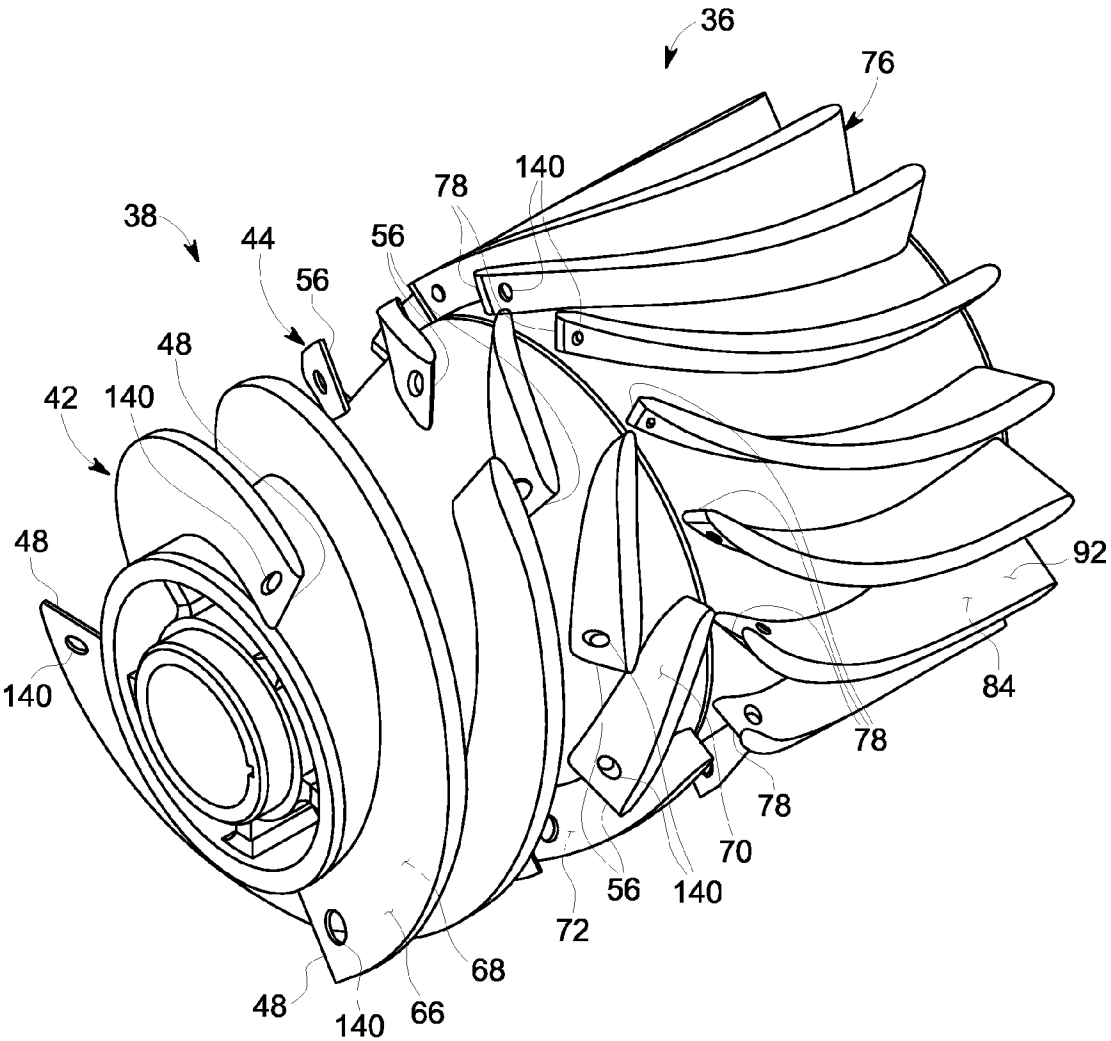
FIG. 11 is a perspective view of an alternative exemplary rotor and stator that may be used with the pump shown in FIG. 2.

FIG. 11 is a perspective view of an alternative exemplary rotor 38 and stator 36 that may be used with pump 26 shown in FIG. 2. In the exemplary embodiment, pressure balance holes 140 extend at least partially through inducer vanes 42, impeller vanes 44, and diffuser vanes 76. Pressure balance holes 140 are located proximate leading edge 48, leading edge 56, and leading edge 78 of inducer vanes 42, impeller vanes 44, and diffuser vanes 76, respectively. Alternatively, pressure balance holes 140 may extend through only inducer vanes 42, impeller vanes 44, diffuser vanes 76, or any combination thereof. In the exemplary embodiment, each vane of inducer vanes 42, impeller vanes 44, and diffuser vanes 76 include a single pressure balance hole 140. Alternatively, inducer vanes 42, impeller vanes 44, and diffuser vanes 76 may each include more than one pressure balance hole 140 and pressure balance holes 140 may be located in any position along the respective vanes such that pump 26 operates as described herein. Pressure balance holes 140 facilitate dislodging gas bubbles that may form on the suction side of inducer vanes 42, impeller vanes 44, or diffuser vanes 76 by allowing a predetermined amount of the multiphase fluid to flow through pressure balance holes 140. Dislodging gas bubbles that may form on the respective vanes facilitates reducing gas locking of pump 26.

Figure 12:
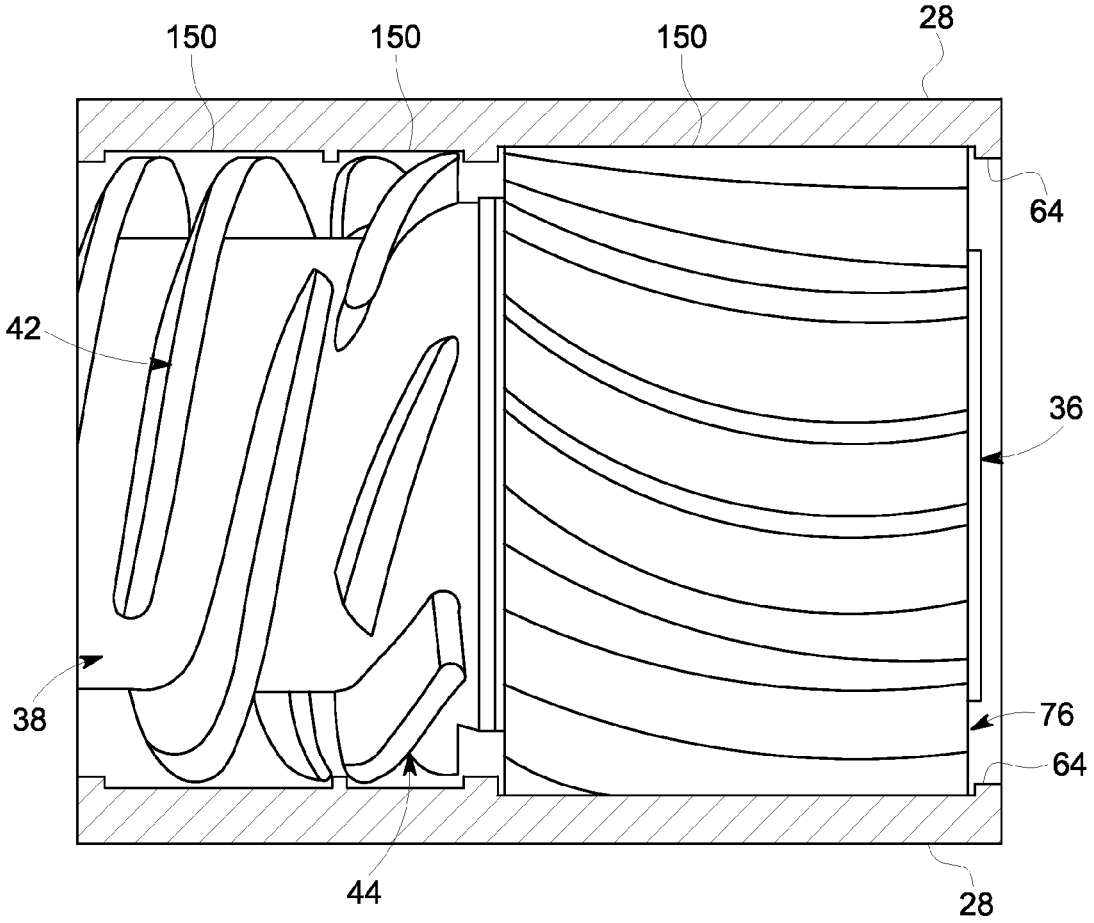
FIG. 12 is a schematic sectional view of an alternative exemplary pump that may be used with the pumping system shown in FIG. 1.

FIG. 12 is a schematic sectional view of an alternative exemplary pump 26 that may be used with pumping system 10 shown in FIG. 1. In the exemplary embodiment, housing 28 includes a plurality of recessed grooves 150 in housing inner surface 64. Recessed grooves 150 extend circumferentially about central axis of rotation 30. Inducer vanes 42 and impeller vanes 44 extend outward from rotor 38 beyond housing inner surface 38 and into one of recessed grooves 150. In addition, diffuser vanes 76 extend outward from stator 36 and beyond housing inner surface 38 and into one of recessed grooves 150. In the exemplary embodiment, grooves 150 are formed in housing inner surface 64 to provide a predetermined amount of clearance between housing 28 and inducer vanes 42, impeller vanes 44, and diffuser vanes 76 respectively, and to facilitate reducing an amount of fluid leakage between inducer vanes 42 and impeller vanes 44, and impeller vanes 44 and diffuser vanes 76 that occurs along housing inner surface 64. Thus, extending at least a portion of inducer vanes 42, impeller vanes 44, and diffuser vanes 76 into recessed grooves 150 facilitates increasing pump 26 efficiency.

The apparatus and systems as described herein facilitate reducing the potential for gas lock in a helico-axial pump. Specifically, the systems and methods described facilitate reducing the separation of a multiphase fluid with a high gas volume fraction into its liquid and gaseous components by using a tandem rotor having an inducer portion with a low inducer vane count combined with a large overlap angle, a high impeller vane count combined with a small overlap angle, and a progressively decreasing rotor flow passage. Therefore, in contrast to known helico-axial pumps, the apparatus and systems described herein facilitate reducing the potential for gas lock and permit the helico-axial pump to pump multiphase fluids that contain a significant portion of gas phase.

Exemplary embodiments for a helico-axial pump are described above in detail. The apparatus and systems are not limited to the specific embodiments described herein, but rather, operations of the systems and components of the systems may be utilized independently and separately from other operations or components described herein. For example, the systems and apparatus described herein may have other industrial or consumer applications and are not limited to practice with submersible pumps as described herein. Rather, one or more embodiments may be implemented and utilized in connection with other industries.

Although specific features of various embodiments of the invention may be shown in some drawings and not in others, this is for convenience only. In accordance with the principles of the invention, any feature of a drawing may be referenced or claimed in combination with any feature of any other drawing.

This written description uses examples to disclose the invention, including the best mode, and to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A helico-axial pump for pumping a multiphase fluid, said helico-axial pump comprising:

a housing having a longitudinal axis and an inner surface;

a rotor positioned within said housing and comprising a rotor inlet portion and a rotor outlet portion, said rotor further comprising:

a rotor hub comprising an outer surface;

an inducer section comprising a plurality of inducer vanes coupled to said rotor hub, each vane of said plurality of inducer vanes comprising a leading edge and a trailing edge, wherein said leading edge of a respective inducer vane circumferentially overlaps said trailing edge of an adjacent inducer vane and defines a first overlap angle measured circumferentially from the longitudinal axis; and an impeller section comprising a plurality of impeller vanes coupled to said rotor hub, each vane of said plurality of impeller vanes comprising a leading edge and a trailing edge, wherein said leading edge of a respective impeller vane circumferentially overlaps said trailing edge of an adjacent impeller vane and defines a second overlap angle measured circumferentially from the longitudinal axis, wherein the first overlap angle is larger than the second overlap angle;

a rotor flow channel extending between said rotor hub outer surface and said housing inner surface, said rotor flow channel having a rotor inlet area extending between said rotor hub outer surface and said housing inner surface at said rotor inlet portion, and a rotor outlet area extending between said rotor hub outer surface and said housing inner surface at said rotor outlet portion, wherein the rotor outlet area is smaller than the rotor inlet area;

a stator positioned within said housing downstream from and adjacent to said rotor, said stator comprising a stator inlet portion and a stator outlet portion, said stator further comprising:

a stator hub comprising an outer surface; and a plurality of diffuser vanes coupled to said stator hub; and a stator flow channel extending between said stator hub outer surface and said housing inner surface, said stator flow channel having a stator inlet area extending between said stator hub outer surface and said housing inner surface at said stator inlet portion, and a stator outlet area extending between said stator hub outer surface and said housing inner surface at said stator outlet portion, wherein the stator inlet area corresponds to the rotor outlet area, and the stator outlet area is larger than the stator inlet area.

2. The helico-axial pump in accordance with claim 1, wherein at least one of said plurality of inducer vanes and said plurality of impeller vanes comprises a vane tip extending therefrom at least partially towards said outlet portion.

3. The helico-axial pump in accordance with claim 1, wherein at least one of said plurality of inducer vanes and said plurality of impeller vanes comprises a groove therein that is configured to facilitate control of a flow profile of the multiphase fluid.

4. The helico-axial pump in accordance with claim 1, wherein at least one of said plurality of inducer vanes and said plurality of impeller vanes comprises at least one pressure balance hole extending at least partially therethrough.

5. The helico-axial pump in accordance with claim 1, wherein said housing inner surface comprises at least one groove therein, wherein at least a portion of at least one of said plurality of inducer vanes and said plurality of impeller vanes extends into said at least one groove to facilitate reducing an amount of fluid leakage between said plurality of inducer vanes and said plurality of impeller vanes.

6. The helico-axial pump in accordance with claim 1, wherein the first overlap angle is within a range between 100 degrees and 300 degrees.

7. The helico-axial pump in accordance with claim 1, wherein the second overlap angle is within a range between 0 degrees and 20 degrees.

8. The helico-axial pump in accordance with claim 1, wherein a ratio of the rotor outlet area to the rotor inlet area is within a range between 0.3 and 0.5.

9. The helico-axial pump in accordance with claim 1, wherein an axial separation between said trailing edge of a respective inducer vane and said leading edge of a respective impeller vane is within a range between 1/10 and 10 times a vane thickness.

10. The helico-axial pump in accordance with claim 1, wherein said plurality of diffuser vanes comprises a first set of diffuser vanes, each comprising a trailing edge, and a second set of diffuser vanes, each comprising a leading edge, said second set of diffuser vanes coupled to said stator downstream from said first set of diffuser vanes.

11. The helico-axial pump in accordance with claim 1, wherein at least one vane of said plurality of diffuser vanes comprises a groove formed in a face of said at least one vane, said groove extending along a path that is continuous from a leading edge to a trailing edge of said at least one vane, said groove configured to facilitate control of a flow profile of the multiphase fluid.

12. The helico-axial pump in accordance with claim 1, wherein at least one vane of said plurality of diffuser vanes comprises at least one pressure balance hole extending at least partially therethrough.

13. The helico-axial pump in accordance with claim 1, wherein at least one vane of said plurality of diffuser vanes comprises a vane tip extending therefrom.

14. The helico-axial pump in accordance with claim 10, wherein said trailing edge of a respective diffuser vane of said first set of diffuser vanes extends downstream from said leading edge of a respective diffuser vane of said second set of diffuser vanes defining an axial overlap distance between 1/10 and 10 times a vane thickness.

15. A system for pumping a multiphase fluid, said system comprising:

a pump driving mechanism;

a fluid conduit; and a helico-axial pump rotatably coupled to said pump driving mechanism and coupled in flow communication to said fluid conduit, said helico-axial pump including at least one stage comprising:

a housing having a longitudinal axis and an inner surface;

a rotor positioned within said housing and comprising a rotor inlet portion and a rotor outlet portion, said rotor further comprising:

a rotor hub comprising an outer surface;

an inducer section comprising a plurality of inducer vanes coupled to said rotor hub, each vane of said plurality of inducer vanes comprising a leading edge and a trailing edge, wherein said leading edge of a respective inducer vane circumferentially overlaps said trailing edge of an adjacent inducer vane and defines a first overlap angle measured circumferentially from the longitudinal axis; and an impeller section comprising a plurality of impeller vanes coupled to said rotor hub, each vane of said plurality of impeller vanes comprising a leading edge and a trailing edge, wherein said leading edge of a respective impeller vane circumferentially overlaps said trailing edge of an adjacent impeller vane and defines a second overlap angle measured circumferentially from the longitudinal axis, wherein the first overlap angle is larger than the second overlap angle;

a rotor flow channel extending between said rotor hub outer surface and said housing inner surface, said rotor flow channel having a rotor inlet area extending between said rotor hub outer surface and said housing inner surface at said rotor inlet portion, and a rotor outlet area extending between said rotor hub outer surface and said housing inner surface at said rotor outlet portion, wherein the rotor outlet area is smaller than the rotor inlet area;

a stator positioned within said housing downstream from and adjacent to said rotor, said stator comprising a stator inlet portion and a stator outlet portion, said stator further comprising:

a stator hub comprising an outer surface; and a plurality of diffuser vanes coupled to said stator hub; and a stator flow channel extending between said stator hub outer surface and said housing inner surface, said stator flow channel having a stator inlet area extending between said stator hub outer surface and said housing inner surface at said stator inlet portion, and a stator outlet area extending between said stator hub outer surface and said housing inner surface at said stator outlet portion, wherein the stator inlet area corresponds to the rotor outlet area, and the stator outlet area corresponds to the rotor inlet area.

16. The system in accordance with claim 15, wherein the first overlap angle is within a range between 100 degrees and 300 degrees, and the second overlap angle is within a range between 0 degrees and 20 degrees.

17. The system in accordance with Claim 15, wherein at least one of said plurality of inducer vanes, said plurality of diffuser vanes, and said plurality of impeller vanes comprises a groove therein that is configured to facilitate control of a flow profile of the multiphase fluid.

18. The system in accordance with claim 15, wherein at least one of said plurality of inducer vanes, said plurality of diffuser vanes, and said plurality of impeller vanes comprises at least one pressure balance hole extending at least partially therethrough.

19. The system in accordance with claim 15, wherein at least one of said plurality of inducer vanes and said plurality of impeller vanes comprises a vane tip extending therefrom at least partially towards said outlet portion.

20. The system in accordance with claim 15, wherein each diffuser vane of said plurality of diffuser vanes extends axially in a curvilinear form, said each diffuser vane comprising a leading edge that pitches towards a direction of rotation of said rotor, and a trailing edge that extends axially along the longitudinal axis.

* * * * *